US009784514B1

(12) United States Patent
Carr

(10) Patent No.: US 9,784,514 B1
(45) Date of Patent: Oct. 10, 2017

(54) EXTRACTOR FOR FIREARMS

(71) Applicant: STI Firearms, LLC, Georgetown, TX (US)

(72) Inventor: Jesse Carr, Freemont, NH (US)

(73) Assignee: STI Firearms, LLC, Georgetown, TX (US)

( * ) Notice: Subject to any disclaimer, the term of this patent is extended or adjusted under 35 U.S.C. 154(b) by 0 days.

(21) Appl. No.: 15/257,454

(22) Filed: Sep. 6, 2016

(51) Int. Cl.
*F41A 15/00* (2006.01)
*F41A 15/14* (2006.01)

(52) U.S. Cl.
CPC ..... *F41A 15/14* (2013.01)

(58) Field of Classification Search
CPC ..... F41A 15/00; F41A 15/10
USPC ..... 42/25, 46
See application file for complete search history.

(56) References Cited

U.S. PATENT DOCUMENTS

| | | | | |
|---|---|---|---|---|
| 7,469,496 | B1 * | 12/2008 | Kellgren | F41A 15/10 42/46 |
| 8,984,787 | B1 * | 3/2015 | O'Clair | F41A 15/14 42/25 |
| 9,518,791 | B1 * | 12/2016 | Heizer | F41A 19/29 |
| 2012/0167427 | A1 * | 7/2012 | Zukowski | F41A 15/14 42/25 |
| 2015/0267983 | A1 * | 9/2015 | Lee | F41A 15/14 42/25 |

* cited by examiner

*Primary Examiner* — J. Woodrow Eldred
(74) *Attorney, Agent, or Firm* — Fish & Richardson P.C.

(57) ABSTRACT

An extractor for a firearm. The extractor includes an extractor body, an edge at a first end of the extractor body, a pivot at a second end of the extractor body, opposite the first end, and a locking portion. The extractor edge is configured to engage a bullet casing. The pivot is configured to permit the extractor to pivot about a first axis and to pivot about a second axis that is orthogonal to the first axis when the extractor is installed within a firearm slide. The locking portion is configured to engage with a corresponding locking element in the firearm slide.

20 Claims, 5 Drawing Sheets

EXTRACTOR FOR FIREARMS

TECHNICAL FIELD

This invention relates to bullet casing extraction systems in firearms.

BACKGROUND

Firearm extractors are used to remove bullet casings from the chamber of firearms. An extractor engages a rim or extractor groove of a bullet casing, and, during a cocking or recoil action of a firearm bolt or slide, pulls an empty casing from the firearm's chamber in preparation for loading a subsequent cartridge.

SUMMARY

In general, innovative aspects of the subject matter described in this specification include an extractor for a firearm. The extractor includes an extractor body, an edge at a first end of the extractor body, a pivot at a second end of the extractor body, opposite the first end, and a locking portion. The extractor edge is configured to engage a bullet casing. The pivot is configured to permit the extractor to pivot about a first axis and to pivot about a second axis that is orthogonal to the first axis when the extractor is installed within a firearm slide. The locking portion is configured to engage with a corresponding locking element in the firearm slide. This and other implementations can each optionally include one or more of the following features.

In some implementations, the locking portion is configured to engage with the corresponding locking element in the slide when the extractor is pivoted into a first position about the second axis.

In some implementations, the second axis is substantially aligned with a width of the extractor body extending between an external surface of the extractor and an internal surface of the extractor.

In some implementations, the extractor is prevented from pivoting about the first axis when the extractor is in the first position about the second axis, and the extractor is free to pivot about the first axis when the extractor is in a second position about the second axis.

In some implementations, the locking portion is a first portion of an upper surface of the extractor that is adjacent to a second portion of the upper surface that is beveled. In some implementations, the beveled second portion of the upper surface defines a locking surface on the locking portion.

In some implementations, the pivot is dome shaped.

In some implementations, the extractor is configured to pivot into the first position about the second axis under recoil forces of a firearm.

In some implementations, the first position about the second axis is a locked position and a second position about the second axis is an unlocked position.

In some implementations, a portion of the extractor is narrower than an extractor housing in the firearm slide so as to permit the extractor to pivot about the second axis when installed within the firearm slide.

A second general aspect can be embodied in a cartridge case extraction system for a firearm. The cartridge case extraction system includes a firearm slide, and an extractor. The extractor is installed within the firearm slide such that the extractor is free to pivot about a first axis and about a second axis that is orthogonal to the first axis. The extractor includes a locking portion that engages with a corresponding locking element in the slide. This and other implementations can each optionally include one or more of the following features.

In some implementations, the locking portion is configured to engage with the corresponding locking element in the slide when the extractor is pivoted into a first position about the second axis.

In some implementations, the extractor is prevented from rotating about the first axis when the extractor is in the first position about the second axis, and the extractor is free to pivot about the first axis when the extractor is in a second position about the second axis.

In some implementations, the extractor includes an extractor body, and the second axis is substantially aligned with a width of the extractor body extending between an external surface of the extractor and an internal surface of the extractor.

In some implementations, the extractor is prevented from pivoting about the first axis when the extractor is in the first position about the second axis, and wherein the extractor is free to pivot about the first axis when the extractor is in a second position about the second axis.

In some implementations, the beveled second portion of the upper surface defines a locking surface on the locking portion.

In some implementations, the extractor is configured to pivot into the first position about the second axis under recoil forces of a firearm.

In some implementations, the first position about the second axis is a locked position and a second position about the second axis is an unlocked position.

In some implementations, a portion of the extractor is narrower than an extractor housing in the firearm slide so as to permit the extractor to pivot about the second axis when installed within the firearm slide.

In a third general aspect, innovative aspects of the subject matter described in this specification can be embodied in a method of manufacturing a cartridge case extraction system for a firearm. The method includes providing a firearm slide having a locking element. Providing an extractor having a locking portion configured to engage with the locking element in the slide. Installing the extractor within the slide such that the extractor is free to pivot about a first axis and about a second axis that is orthogonal to the first axis, and the extractor is prevented from pivoting about the first axis when the locking portion of the extractor is engaged with the locking element in the slide.

The concepts described herein may provide several advantages. For example, implementations of the invention may provide a more secure engagement between an extractor and a bullet casing. Implementations may prevent firearm malfunctions due to un-extracted or partially-extracted casings. Implementations may provide for more consistent extraction of bullet casings from high pressure rounds.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
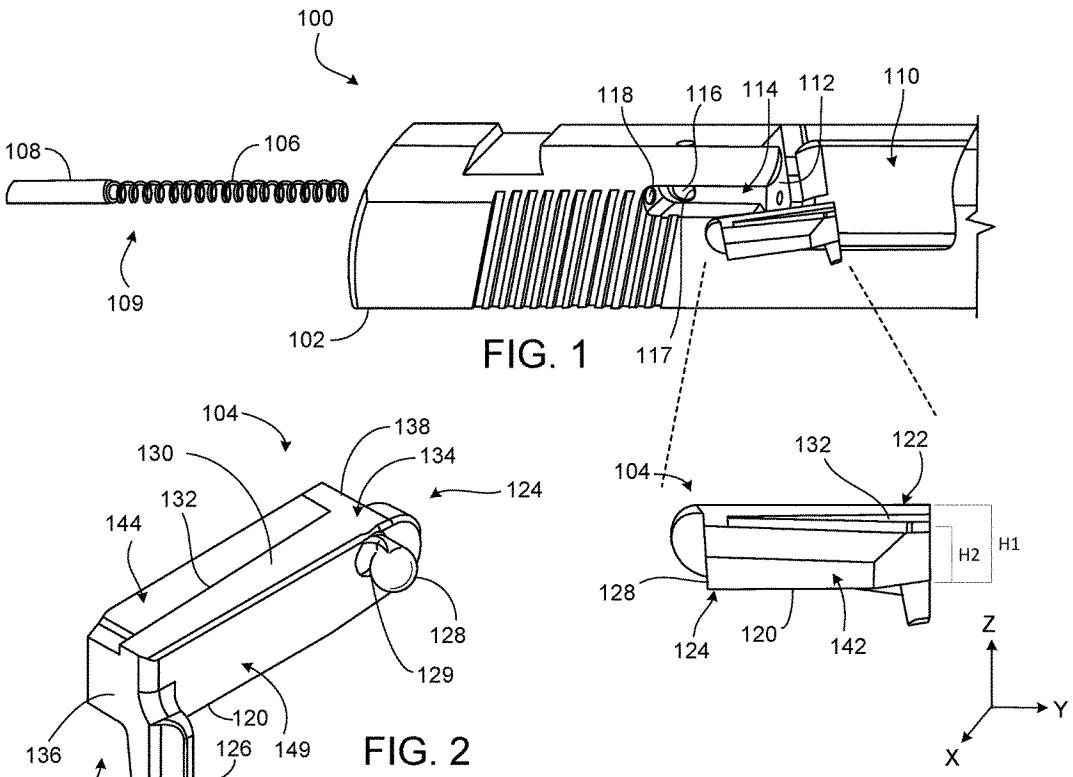
FIG. 1 depicts an exploded diagram of an example firearm slide assembly in accordance with implementations of the present disclosure.

Implementations of the present disclosure are generally directed to an extractor and extraction system for a firearm. The extractor is designed have two degrees of freedom of motion within an extractor housing of a firearm slide. The extractor can pivot about a lateral axis between a locked and unlocked position. When the extractor is in the unlocked position, the extractor is free to pivot about a vertical axis that is substantially orthogonal to the lateral axis. When the extractor is in the locked position, the extractor is mechanically prevented from pivoting about the vertical axis. In some implementations, the extractor is designed so that recoil forces of the firearm cause the extractor to pivot about the lateral axis into the locked position during the case extraction operation of the firearm. In some implementations, the mechanical locking action of the extractor may provide more reliable case extraction than present extractor designs.

For simplicity, implementations of the present disclosure will be described in reference to a semiautomatic handgun, however, one skilled in the art would appreciate that one or more of the implementations described below also may be incorporated into other firearms designs.

As used herein, the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to fire the new round.

As used herein, the term "non-semiautomatic firearm" refers to a firearm which requires a user to manually manipulate some mechanism of the firearm to chamber a new round after each shot.

As used herein, the term "automatic firearm" refers to a firearm which automatically extracts a spent cartridge casing, chambers a new round after each shot, and fires the new round in a repeating fashion with a single pull of the trigger. In an automatic firearm, this process repeats until the trigger is released or all of the ammunition in the firearm is expended.

As used herein, the terms "orthogonal" or "substantially orthogonal" refer to a relation between two elements (eg., lines, axes, planes, surfaces, or components) that forms a ninety degree (perpendicular) angle within acceptable engineering, machining, or measurement tolerances. For example, two surfaces can be considered orthogonal to each other if the angle between the surfaces is within an acceptable tolerance of ninety degrees (e.g., ±1-2 degrees).

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device.

As used herein, the term "recoil forces" refers forces exerted on various components of a firearm (e.g., breech face, slide, frame, recoil spring) which balance the forward momentum of a projectile being discarded from the firearm. Recoil forces are generally experienced directly at the breach face and transmitted through the breach face to other components of the firearm.

As used herein, terms describing relative directions or orientations (e.g., front, back/rear, distal, proximate, top/upper, bottom/lower) of various elements are used in reference to the perspective of a user holding a firearm. Thus, for example, the distal/front edge or surface of a component refers to that edge or surface of the component that is nearest or facing the muzzle of the firearm when the component properly installed in the firearm. Similarly, for example, the back/proximate edge or surface of a component refers to that edge or surface of the component that is farthest from or facing away from the muzzle of the firearm when the component is properly installed in the firearm. Likewise, for example, the top/upper edge or surface of a component refers to that edge or surface of the component that is nearest or facing the top of the firearm when the component is properly installed in the firearm and the firearm is held in a normal firing position. Finally, for example, the bottom/lower edge or surface of a component refers to that edge or surface of the component that is nearest or facing the bottom of the firearm when the component is properly installed in the firearm and the firearm is held in a normal firing position.

Firearms can be designed with ejection ports on either the right or left side of the firearm. For that reason lateral directions or orientations (e.g., right side, left side) of various elements are used in reference to either the ejection port (e.g., ejection port side or non-ejection port side) or whether an edge or surface of a component is oriented internal to or external from the firearm.

FIG. 1 depicts an exploded diagram of an example firearm slide assembly 100 in accordance with implementations of the present disclosure. The slide assembly 100 includes a firearm slide 102, an extractor 104, and an extractor spring assembly 105 which includes an extractor spring 106 and a plunger 108. The slide 102 includes an ejection port 110 on one side of the slide 102 (e.g., the right hand side as depicted). A breech face 112 is located on an internal surface of the slide 102. In operation, the breech face 112 contacts the rear face of a cartridge casing. In addition, the slide 102 includes an extractor housing 114 in which the extractor 104 is installed. The extractor housing 114 includes an extractor pivot interface 116 and an exit hole 118 of a spring assembly channel. The spring assembly channel (not shown) extends through the slide 102 from a rear face of the slide 102 to the exit hole 118 in the extractor housing 114.

In some implementations, the slide assembly 100 may include additional components that are not shown. For example, the slide assembly can include one or more of the following: a safety mechanism, a firing pin and firing pin spring, a striker and striker assembly, a decocking mechanism, and a slide cover plate.

Figure 2:
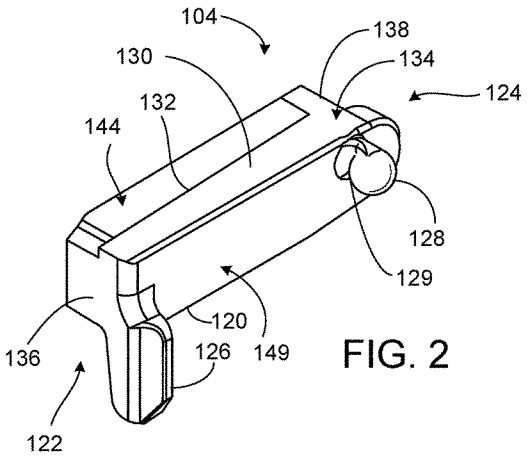
FIG. 2 depicts a perspective view of an example firearm extractor in accordance with implementations of the present disclosure.

FIG. 2 depicts a perspective view of the example firearm extractor 104 in accordance with implementations of the present disclosure. Referring to both FIGS. 1 and 2, the extractor 104 has a body 120 with a front or distal end 122 and a back or proximate end 124. In addition, the extractor body 120 has a top surface 134, front surface 136, rear surface 138, internal surface 140, and external surface 142. The extractor 104 has a casing engagement edge 126 extending from the distal end 122 of the body 120. As described in more detail below, the casing engagement edge 126 is configured to engage the head of a cartridge case in order to extract the case from the chamber of a firearm. A pivot 128 extends outward at the proximate end 124 of the extractor body 120. In some implementations (e.g., as shown), the pivot 128 extends from the internal surface 140 of the extractor body 120. Furthermore, the pivot 128 includes a lip 129 that engages with a corresponding edge 117 in the pivot interface 116. For example, the pivot interface 116 may be undercut slightly to form the edge 117.

The top surface 134 of the extractor body 120 includes a locking portion 130. A second, lower surface 144 is adjacent to the locking portion 130. The lower surface 144 is beveled or cut slightly lower than the locking portion 130, thereby, forming a locking edge or locking surface 132 on the extractor. The height (H1) of the portion of the extractor body 120 that includes the locking portion 130 is greater than the height (H2) of the portion of the extractor body 120 that includes the lower surface 144. Furthermore, the height (H2) is narrower than the height of the extractor housing 114 in the slide 102 to permit the extractor 104 to pivot up and down about a lateral axis (e.g., in the x-axis). For example, the lateral axis can be substantially aligned with a width of the extractor 104 and substantially perpendicular to the length of the extractor 104. As described in more detail below, the locking portion 130 is configured to engage with a locking element in the slide 102 during the recoil of a firearm, and thereby, improve the reliability of the firearm.

In some examples, the bevel angle or depth of the cut to form the lower surface 144 is dependent on the desired height of the locking portion 130 or the depth of a corresponding locking element in the slide 102. In some examples, the angle or depth of the cut to form the lower surface 144 is determined based on the dimensions of a particular caliber cartridge casing.

The extractor 104 is installed within the extractor housing 114 of the slide 102. When the extractor 104 is installed in the extractor housing 114, the pivot 128 engages the pivot interface 116. The pivot interface 116 is generally concave and configured to accept the pivot 128 while permitting pivoting motion of the extractor 104 within the extractor housing 114. In some implementations, the pivot 128 and pivot interface 116 are similar to a ball and socket joint.

The extractor spring assembly 105 is installed in the spring assembly channel of the slide 102. The extractor spring 106 extends through the channel exit hole 118 and engages the rear surface 138 of the extractor body 120. The extractor spring assembly 105 can be retained in place with a locking mechanism (e.g., a pin or slide cover plate). The extractor spring 106 applies a bias force to the extractor 104. The bias force pushes the extractor forward within the extractor housing 114 causing the pivot lip 129 to engage the edge within the pivot interface 116 and, thereby, retain the extractor 104 within the extractor housing 114 during the operation of a firearm. In addition, the spring biases the extractor to pivot about a vertical axis (e.g., in the z-direction) such that the extractor edge 126 is biased in a direction towards the vertical center plane of the breech face 112.

When installed in the extractor housing 114, the pivot 128 and pivot interface 116 are configured to permit the extractor to pivot about two axes; a vertical axis (z-direction) and a lateral axis (x-direction). For example, the vertical axis can be substantially orthogonal to the lateral axis. As explained in more detail below, the extractor 104 design (e.g., pivot 128, locking portion 130, and lower surface 144) permits the extractor to pivot about the lateral axis (e.g., upwards) during the recoil of a firearm, thereby, causing the locking portion 130 to engage a corresponding locking element (e.g., a locking channel) in an upper surface of the extractor housing 114 within the slide 102. Consequently, during the recoil of a firearm the extractor 104 is prevented from pivoting away from the vertical center plane of the breech face 112 about the vertical axis. The locking function may provide a more secure engagement between the extractor 104 and a cartridge casing being extracted from the chamber of the firearm.

Figure 3:
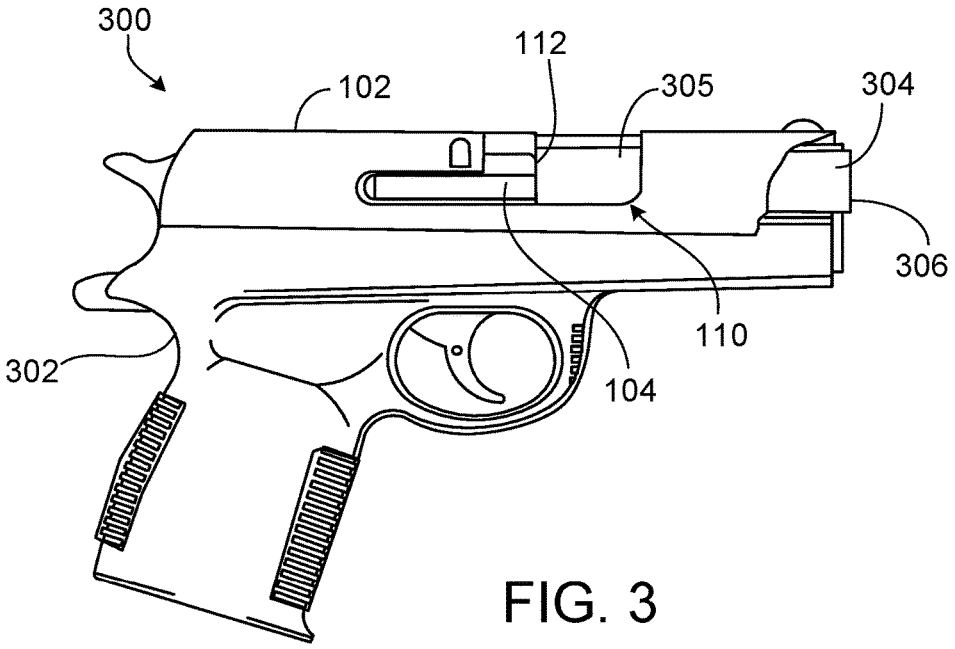
FIGS. 3 and 4 depict an example semiautomatic firearm during recoil.
Figure 4:
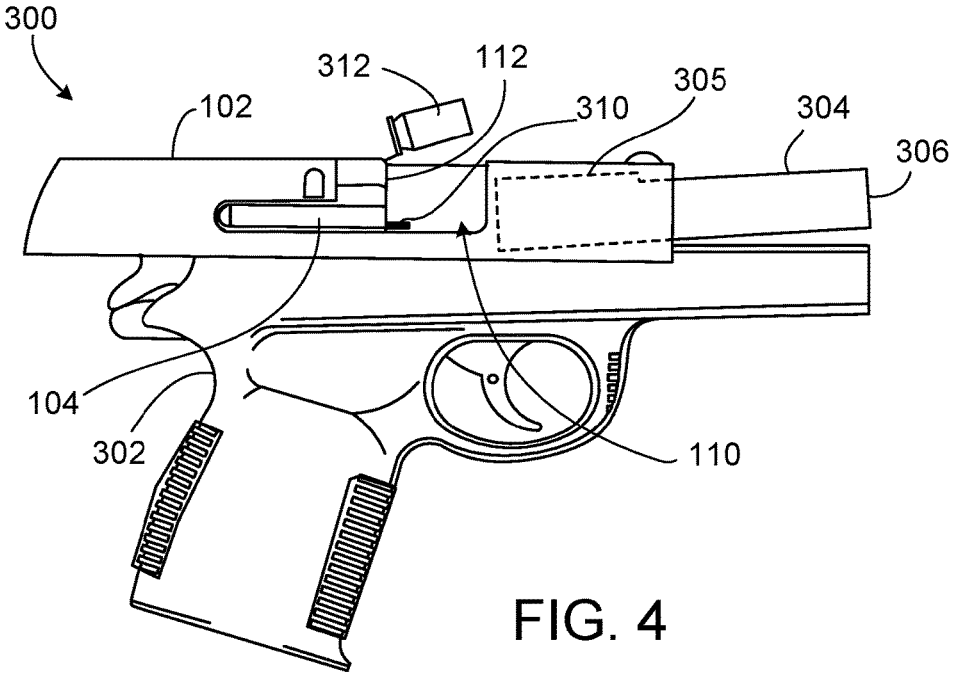

FIGS. 3 and 4 depict an example semiautomatic firearm 300 during recoil. The firearm 300 includes a frame 302 and barrel 304. The barrel 304 includes a chamber 305 and a muzzle 306. An ejector 310 is attached to the frame 302 (FIG. 4) for ejecting empty cartridge casings 312 out of the firearm 300 through the ejection port 110.

The cycle of operations for an example semiautomatic firearm 300 includes firing, case extraction, case ejection, cocking, feeding a new cartridge, and chambering the new cartridge. After the firearm 300 is fired, recoil (or gas, or blowback) forces push the slide 102 rearward. The extractor 104 (specifically the extractor edge 126), which engages with a rim of the empty casing 312, pulls the empty casing 312 from the chamber 305 as the slide 102 moves rearward. As the slide 102 continues rearward the head of the empty casing 312 impacts the ejector 310 and the empty casing 312 is ejected from the firearm 300 through the ejection port 110. Upon reaching full travel, the firearm is cocked and the slide 102 is forced back forward by a recoil spring. During its forward travel, the slide 102 strips a new cartridge from a magazine and feeds the new cartridge into the chamber 305. As the slide 102 feeds the new cartridge into the chamber 305, the extractor 104 pivots, about the vertical axis, away from the slide 102 and breech face 112 as the extractor edge 126 engages with the new cartridge case.

In some situation with standard extractors, the empty cartridge casing 312 may fail to be completely extracted from the chamber 305. For example, friction between the casing 312 and the inside walls of the chamber 305 can increase if the chamber 305 is dirty or due to excessive expansion of the case walls when high pressure ammunition is used. In some examples, the extractor spring 106 may be too weak to maintain the extractor's positive engagement with the case 312. However, an extractor spring 106 cannot be made too stiff otherwise the extractor 104 will not properly engage with the rim of new cartridges as they are feeding into the chamber 305. This could result in the firearm not properly begin returned to battery. As illustrated in FIGS. 5-8B and described below, the second pivoting action and the locking portion 130 of implementations of the extractor 104 described herein aid in maintaining proper engagement between the extractor edge 126 and the cartridge casing 312 during the extraction process without adjustment to the extractor spring 106.

Figure 6:
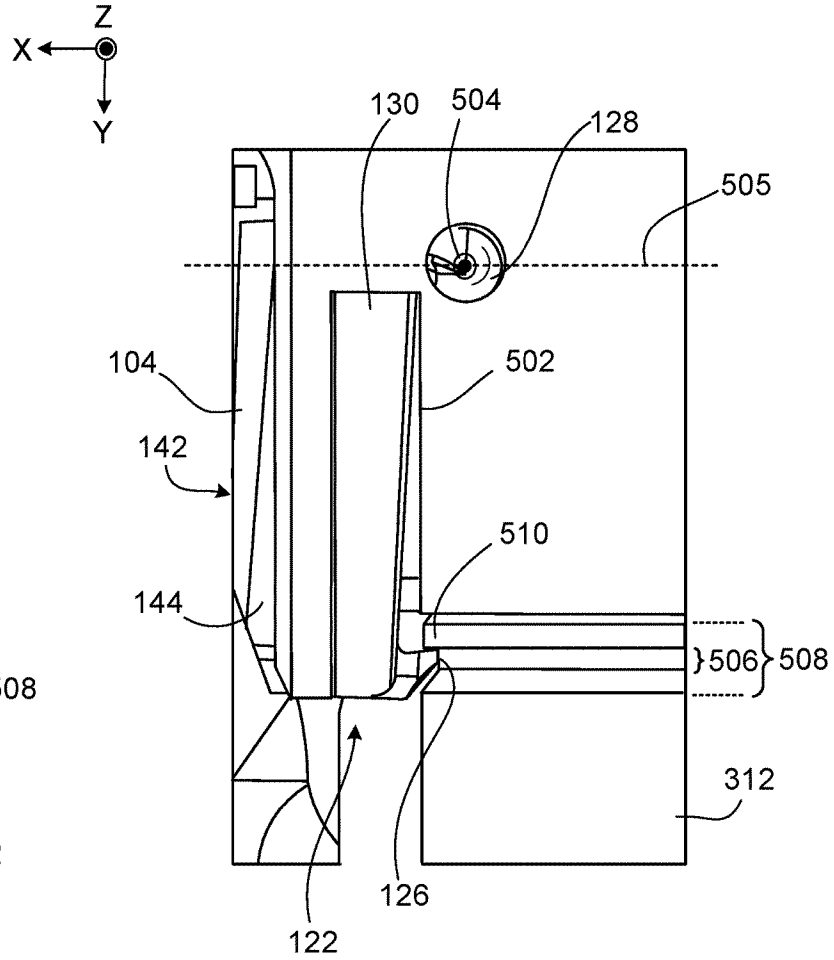
FIGS. 5 and 6 depict the operation of the example extractor from a top cutaway view of the firearm slide and extractor.
Figure 5:
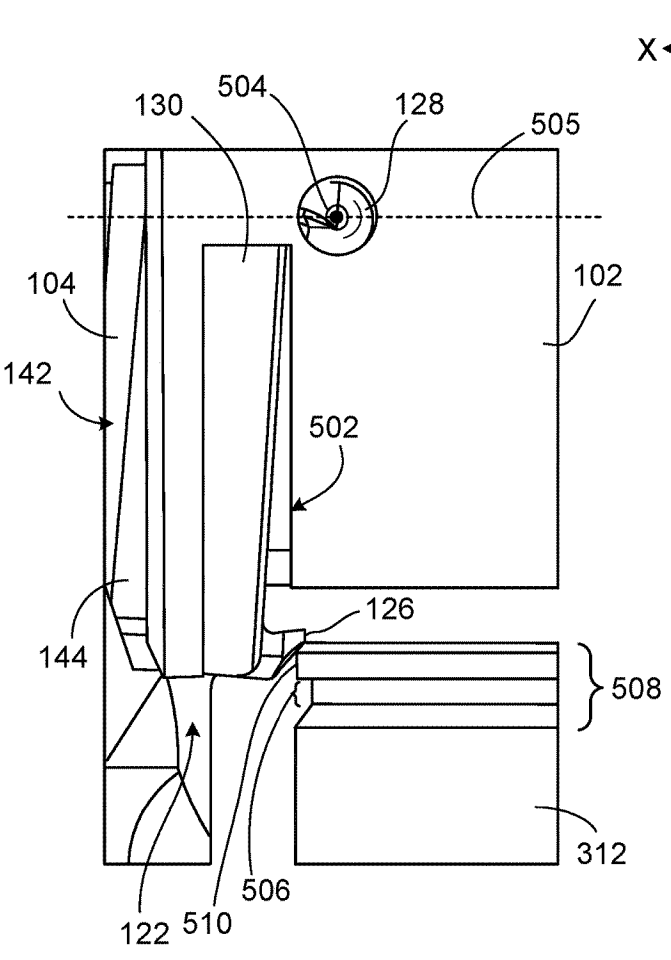

FIGS. 5 and 6 depict the operation of the example extractor 104 from a top cutaway view of the firearm slide 102 and extractor 104. The locking element 502 in the slide 102 is illustrated in the cutaway view of the firearm slide 102 of FIGS. 5 and 6. For example, as depicted in FIGS. 5 and 6, the locking element can be formed as a channel in the slide 102 that is configured to accept the locking portion 130 of the extractor 104.

In addition, FIGS. 5 and 6 include the vertical axis (z-axis) 504 and the lateral axis (x-axis) about which the extractor 104 pivots. Together, FIGS. 5 and 6 depict the pivoting motion of the extractor about the vertical axis 504. Both FIGS. 5 and 6 depict the extractor 104 engaging a cartridge casing 312 during the forward motion of the slide 102 as part of the chambering step of the firearms operation cycle. Specifically, FIG. 5 illustrates the "hard chambering" of a cartridge, for example, when a cartridge is not feed from a magazine, but is already, at least partially, inserted into a firearm's chamber. The cartridge casing 312 is illustrated in more detail than in FIGS. 3 and 4, and includes a casing head 508, an extractor groove 506, and a rim 510.

Referring first to FIG. 5, as slide 102 moves forward into battery with a cartridge casing 312 at least partially chambered, the extractor 104 pivots outward about the vertical axis 504 (away from the slide 102) against the pressure of the extractor spring 106 (shown in FIG. 1). This motion permits the extractor edge 126 to slide past the casing head 508 such that the casing head can come into contact with the breech face 112. During the forward motion, the extractor 104 rests in a lower position about the lateral axis 505 such that the locking portion 130 does not engage with the locking element 502.

As shown in FIG. 6, as the extractor edge 126 passes the casing rim 510, the extractor 104 pivots, about the vertical axis 504, back toward the slide 102 under the force of the extractor spring 106 and the extractor edge 126 engages the extractor groove 506 and rim 510 of the case head 508. In this position, the locking portion 130 is aligned with the locking element 502 of the slide 102.

During normal chambering (e.g., from a magazine), as the slide 102 strips a new round from a magazine during its forward motion, the extractor 104 will generally remain aligned with the locking element 502, but may pivots outward slightly about the vertical axis 504 (away from the slide 102). When feed from a magazine, the casing head 508 does not slide past the extractor edge 126, but slides along and behind the extractor edge 126 and up the. During normal chambering, the extractor 104 may or may not engage the locking element 502 in the slide 102 since the extractor's 104 rotation about a vertical axis 504 during normal chambering is slight and generally the locking portion 130 does not travel past the locking element 502.

Figure 7A:
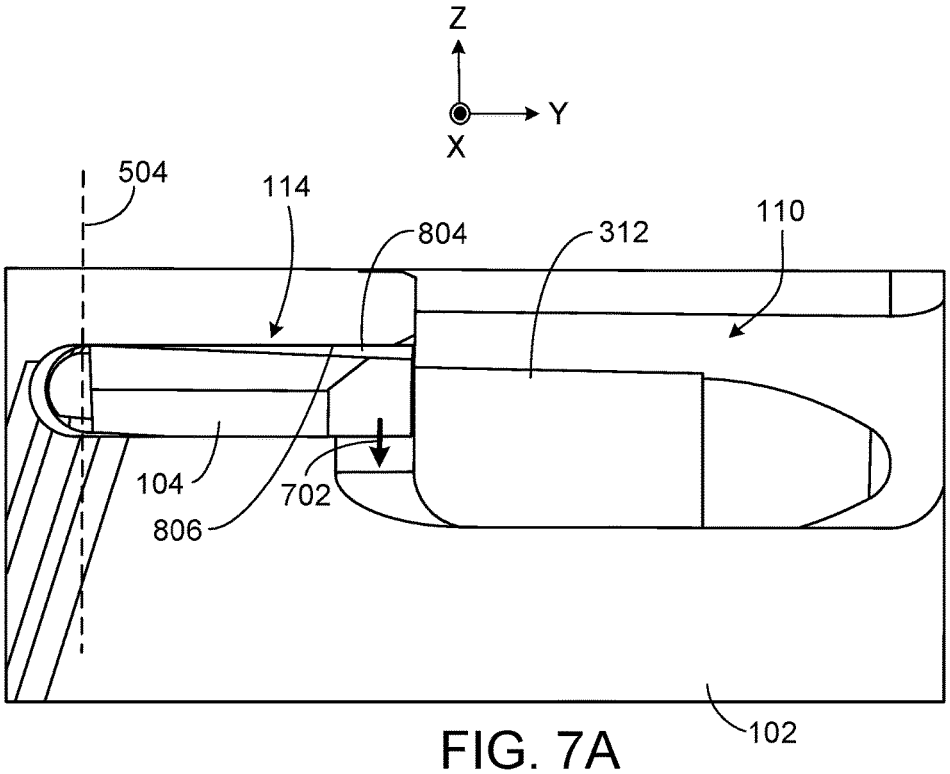
FIGS. 7A-7B depict the operation of the example extractor from an ejection port side view of the firearm slide and extractor.
Figure 7B:
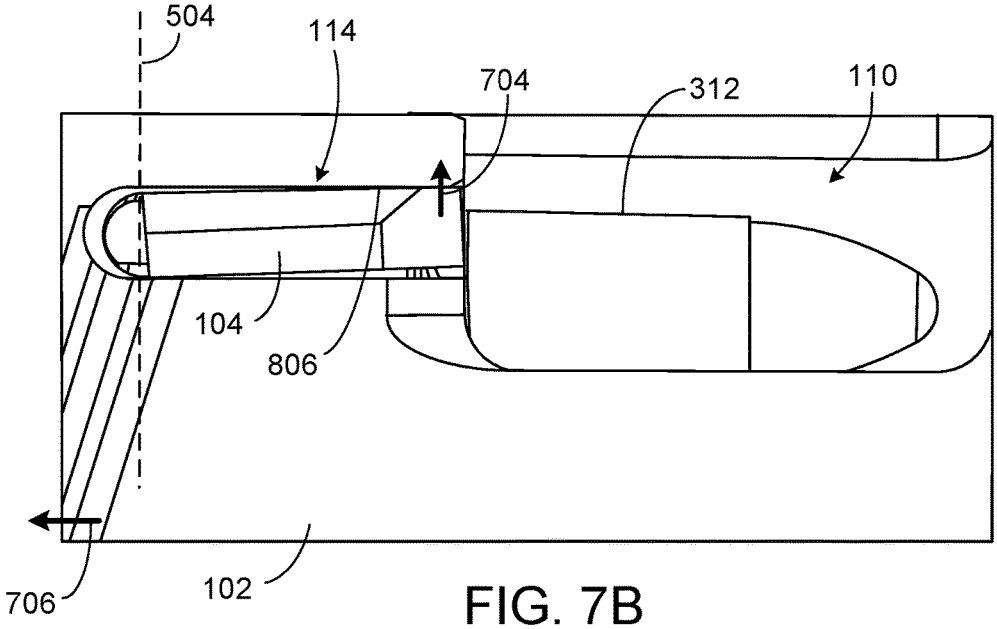
Figure 8A:
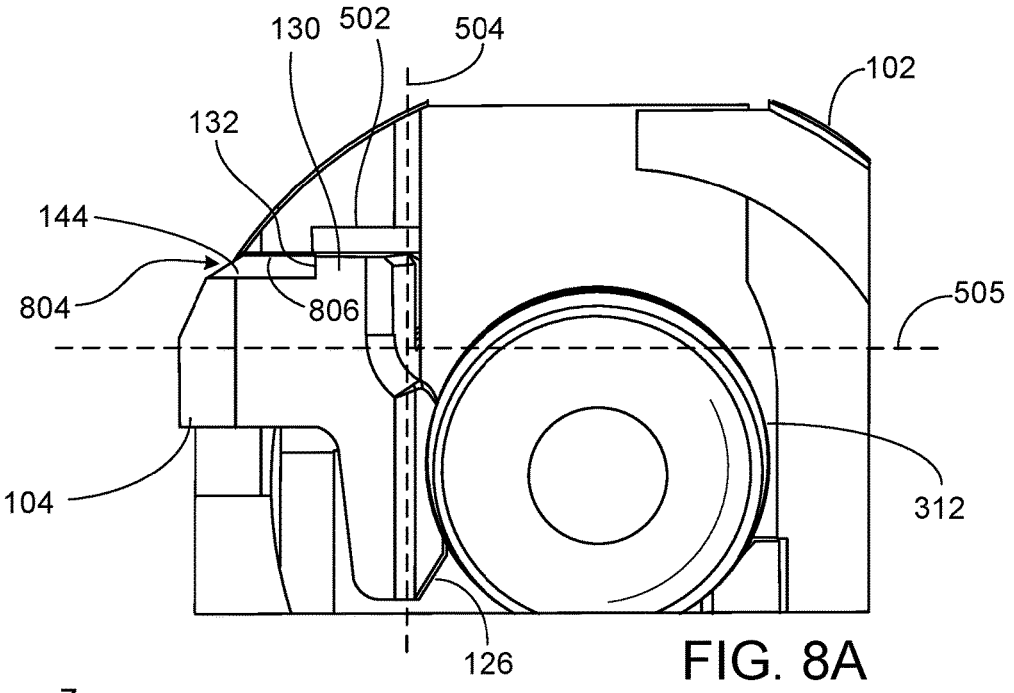
FIGS. 8A-8B depict the operation of the example extractor from front cutaway view of the firearm slide and extractor.
Figure 8B:
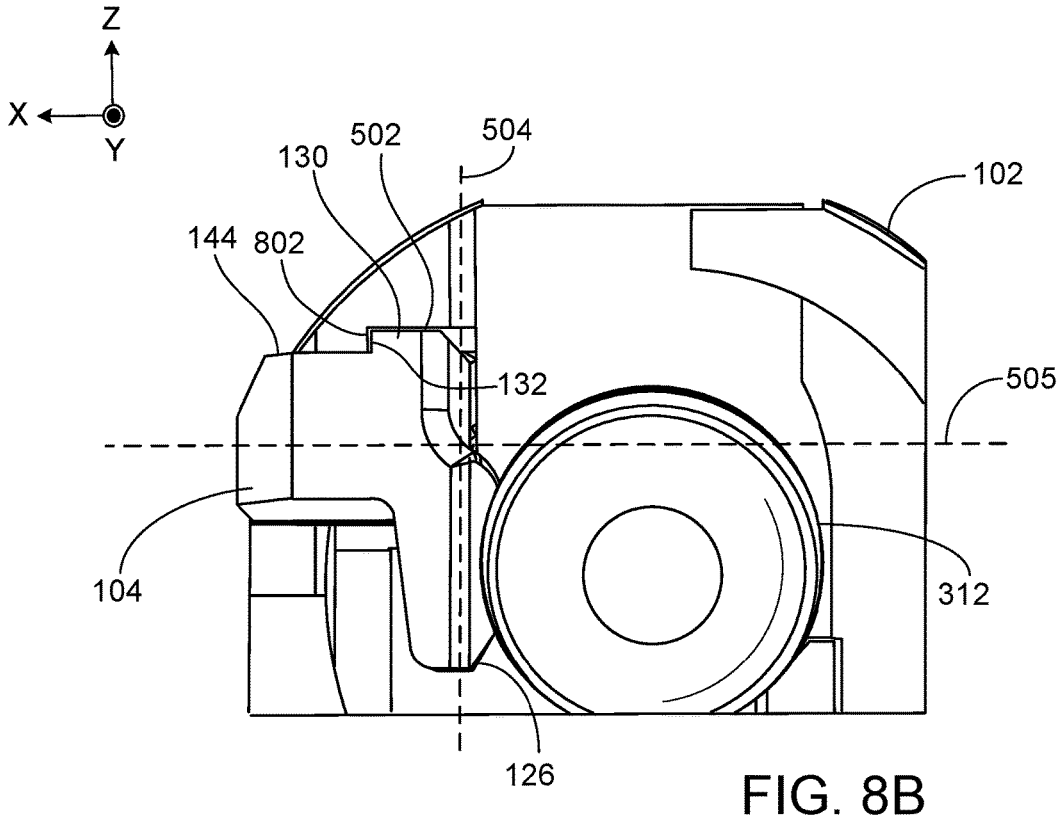

FIGS. 7A-7B depict the operation of the example extractor 104 from an ejection port side view of the firearm slide 102. FIGS. 8A-8B depict the operation of the example extractor 104 from a front cutaway view of the firearm slide 102. FIGS. 7A and 8A illustrate the extractor 104 in a first, unlocked position about the lateral axis 505. In the unlocked position, the extractor 104 rests in a lower position (702) about the lateral axis 505 such that the locking portion 130 does not engage with the locking element 502 of the slide 102. When the extractor edge 126 is engaged in the extractor groove 506 of a cartridge casing 312 or when there is no cartridge present in the firearm, the locking portion 130 of the extractor 104 is aligned with the locking element 502 in the slide 102. When the extractor 104 is in this unlocked position, the extractor 104 is free to pivot about the vertical 504 axis because the locking portion 130 will pass under a side surface 802 of the locking element 502. Furthermore, in the unlocked position, the lower surface 144 of the extractor 104 sits below the extractor housing such that a gap 804 is formed between an upper surface 806 of the extractor housing and the lower surface 144 of the extractor 104.

FIGS. 7B and 8B illustrate the extractor 104 in a second, locked position about the lateral axis 505. In the locked position, the extractor 104 is in an upper position (704) about the lateral axis 505 such that the locking portion 130 engage with the locking element 502 in the slide 102. When the extractor 104 is in the locked position the extractor 104 is prevented from pivoting about the vertical 504 axis because the locking surface 132 of locking portion 130 engages with the side surface 802 of the locking element 502 to prevent the extractor 104 from pivoting outwards away from the slide 102. When the extractor edge 126 is engaged in the extractor groove 506 of a cartridge casing 312 and the extractor 104 is in the locked position, the extractor edge 126 maintains a positive engagement with the case rim 510 during the extraction process. Furthermore, in some examples, in the locked position, the lower surface 144 of the extractor 104 may pivot upwards a sufficient distance to close the gap 804 between an upper surface 806 of the extractor housing and the lower surface 144 of the extractor 104. In some examples, the lower surface 144 is cut or beveled a sufficient distance below the locking portion 130 to allow the locking portion 130 to fully engage the locking element 502.

For example, during the extraction step of the firearm's operation cycle, the reward motion (706) of the slide 102 under recoil (e.g., see FIG. 4) causes the extractor 104 to shift into the locked position. The mechanical lock formed between the locking portion 130 of the extractor and the locking element 502 of the slide may, for example, provide a stronger force for maintaining engagement between the extractor edge 126 and the case rim 510 during case extraction than an extractor spring 106 can provide. Thus, in some implementations, the overall reliability of a firearm can be improved by preventing or reducing firearm malfunctions related to the failure to extract a cartridge.

Although the locking portion 130 has been described and illustrated a as a protrusion or tab extending from the extractor 104 and the locking element 502 in the slide 102 has been described and illustrated as a corresponding channel formed in the slide 102, the structure of the locking portion 130 and locking element 502 is not so limited. More specifically, the locking portion 130 of the extractor and the locking element 102 of the slide can include other corresponding locking mechanisms that prevent the extractor 102 from pivoting laterally during the extraction of a cartridge casing. For example, in some implementations, the locking portion 130 can be formed as a channel in the extractor 104 and the locking element 502 can be formed as a corresponding protrusion from the slide 102.

Although the extractor has been described above in reference to an implementation for use in a semiautomatic pistol slide, in some implementations the extractor can be incorporated into or configured for use in other firearm designs. For example, the extractor can be configured for use in automatic, semiautomatic, or non-semiautomatic pistols and rifles. More specifically, for example, the extractor can be configured for use in a firearm bolt (e.g., a bolt for a lever action, pump action, or bolt action firearm). For example, in such implementations, the manual operation of the firearm bolt (e.g., cycling the bolt rearward) may provide the force necessary to pivot the extractor into the upper, locked position when extracting an empty cartridge casing.

An extraction system for a firearm can be manufactured by providing a firearm slide 102 (or bolt) having a locking element 502 and providing an extractor 104 having a locking portion 130 that is configured to engage with the locking element 502 in the slide 102. The extractor 104 can be installed within the slide 102 such that the extractor is free to pivot about a first (vertical) axis and about a second (lateral) axis (or any two axes that are normal to one another). Furthermore, the extractor 104 is installed such that the extractor 104 is prevented from pivoting about the vertical axis when the locking portion 130 of the extractor 104 is engaged with the locking element 502 in the slide 102.

In some implementations, the locking element 502 can be provided in an upper surface of an extractor housing 114 in the slide 102. In some implementations, the locking portion 130 of the extractor can be formed by creating a cutting or beveling a top surface 134 of the extractor body 120 to form both the locking portion 130 and a lower surface 144 on the top of the extractor body 120.

In some implementations, the extractor is provided with a pivot 128 and the slide 102 is provided with a corresponding pivot interface 116. The pivot 128 can include a lip 129 that engages with a corresponding edge 117 in the pivot interface 116. In some implementations, installing the extractor 104 within the slide 102 includes installing an extractor spring assembly 105 within the slide 102 to retain the extractor 104 within the slide during the operation of a firearm and to provide a bias force on the extractor 104.

While a number of examples have been described for illustration purposes, the foregoing description is not intended to limit the scope of the invention, which is defined by the scope of the appended claims. There are and will be other examples and modifications within the scope of the following claims.

What is claimed is:

1. An extractor for a firearm comprising:

an extractor body;

an edge at a first end of the extractor body, the edge configured to engage a bullet casing;

a pivot at a second end of the extractor body, opposite the first end, and configured to permit the extractor to pivot about a first axis and to pivot about a second axis that is orthogonal to the first axis when the extractor is installed within a firearm slide; and a locking portion configured to engage with a corresponding locking element in the firearm slide.

2. The extractor of claim 1, wherein the locking portion is configured to engage with the corresponding locking element in the slide when the extractor is pivoted into a first position about the second axis.

3. The extractor of claim 1, wherein the second axis is substantially aligned with a width of the extractor body extending between an external surface of the extractor and an internal surface of the extractor.

4. The extractor of claim 1, wherein the extractor is prevented from pivoting about the first axis when the extractor is in the first position about the second axis, and wherein the extractor is free to pivot about the first axis when the extractor is in a second position about the second axis.

5. The extractor of claim 1, wherein the locking portion is a first portion of an upper surface of the extractor that is adjacent to a second portion of the upper surface that is beveled.

6. The extractor of claim 5, wherein the beveled second portion of the upper surface defines a locking surface on the locking portion.

7. The extractor of claim 1, wherein the pivot is dome shaped.

8. The extractor of claim 1, wherein the extractor is configured to pivot into the first position about the second axis under recoil forces of a firearm.

9. The extractor of claim 1, wherein the first position about the second axis is a locked position and a second position about the second axis is an unlocked position.

10. The extractor of claim 1, wherein a portion of the extractor is narrower than an extractor housing in the firearm slide so as to permit the extractor to pivot about the second axis when installed within the firearm slide.

11. A cartridge case extraction system for a firearm comprising:

a firearm slide; and an extractor installed within the firearm slide such that the extractor is free to pivot about a first axis and about a second axis that is orthogonal to the first axis, the extractor comprising a locking portion that engages with a corresponding locking element in the slide.

12. The system of claim 11, wherein the locking portion is configured to engage with the corresponding locking element in the slide when the extractor is pivoted into a first position about the second axis.

13. The system of claim 11, wherein the extractor is prevented from rotating about the first axis when the extractor is in a first position about the second axis, and wherein the extractor is free to pivot about the first axis when the extractor is in a second position about the second axis.

14. The system of claim 11, wherein the extractor includes an extractor body, and wherein the second axis is substantially aligned with a width of the extractor body extending between an external surface of the extractor and an internal surface of the extractor.

15. The system of claim 11, wherein the extractor is prevented from pivoting about the first axis when the extractor is in a first position about the second axis, and wherein the extractor is free to pivot about the first axis when the extractor is in a second position about the second axis.

16. The system of claim 11, wherein the locking portion of the extractor is defined by a bevel in an upper surface of the extractor.

17. The system of claim 11, wherein the extractor is configured to pivot into a first position about the second axis under recoil forces of a firearm.

18. The system of claim 11, wherein a first position about the second axis is a locked position and a second position about the second axis is an unlocked positon.

19. The system of claim 11, wherein a portion of the extractor is narrower than an extractor housing in the firearm slide so as to permit the extractor to pivot about the second axis when installed within the firearm slide.

20. A method of manufacturing a cartridge case extraction system for a firearm comprising:

providing a firearm slide having a locking element;

providing an extractor having a locking portion configured to engage with the locking element in the slide; and installing the extractor within the slide such that the extractor is free to pivot about a first axis and about a second axis that is orthogonal to the first axis, wherein the extractor is prevented from pivoting about the first axis when the locking portion of the extractor is engaged with the locking element in the slide.

* * * * *